US010446338B2

(12) United States Patent
Lin

(10) Patent No.: US 10,446,338 B2
(45) Date of Patent: Oct. 15, 2019

(54) LINKAGE ASSEMBLY AND KEY SWITCH DEVICE HAVING THE SAME

(71) Applicant: Sunrex Technology Corp., Taichung (TW)

(72) Inventor: Shih-Pin Lin, Taichung (TW)

(73) Assignee: Sunrex Technology Corp., Taichung (TW)

( * ) Notice: Subject to any disclaimer, the term of this patent is extended or adjusted under 35 U.S.C. 154(b) by 16 days.

(21) Appl. No.: 15/943,988

(22) Filed: Apr. 3, 2018

(65) Prior Publication Data

US 2019/0221378 A1 Jul. 18, 2019

(30) Foreign Application Priority Data

Jan. 17, 2018 (TW) ..... 107101634 A

(51) Int. Cl.

| | |
|---|---|
| ***H01H 3/12*** | (2006.01) |
| ***H01H 13/705*** | (2006.01) |
| ***H01H 13/52*** | (2006.01) |
| ***H01H 13/14*** | (2006.01) |

(52) U.S. Cl.

CPC ..... *H01H 3/122* (2013.01); *H01H 13/14* (2013.01); *H01H 13/52* (2013.01); *H01H 13/705* (2013.01)

(58) Field of Classification Search

CPC ..... H01H 3/122; H01H 13/14; H01H 13/52; H01H 13/705

USPC ..... 200/344, 345

See application file for complete search history.

(56) References Cited

U.S. PATENT DOCUMENTS 6,072,134 A * 6/2000 Sato ..... H01H 3/125 200/344

8,110,764 B2 * 2/2012 Hsu ..... H01H 3/125 200/344

* cited by examiner

*Primary Examiner* — Edwin A. Leon

*Assistant Examiner* — Lheiren Mae A Caroc

(74) *Attorney, Agent, or Firm* — MLO, a professional corp.

(57) ABSTRACT

A linkage assembly is provided for guiding movement of a key cap relative to a support board between a normal position and a pressed position. The linkage assembly includes a left modular linking member, a right modular linking member, and a pair of synchronizing units for synchronize movement of the left and right modular linking members. Each of the synchronizing units has a first pin, a second pin, a first hole, and a second hole. In the normal position, the first and second pins are in substantially full frictional engagement within the first and second holes, respectively. In the pressed position, the first and second pins are in loose frictional engagement within the first and second holes, respectively.

12 Claims, 10 Drawing Sheets

LINKAGE ASSEMBLY AND KEY SWITCH DEVICE HAVING THE SAME

CROSS-REFERENCE TO RELATED APPLICATION

This application claims priority from Taiwanese invention patent application no. 107101634, filed on Jan. 17, 2018.

FIELD

The disclosure relates to a linkage assembly, more particularly to a key switch device having the linkage assembly.

BACKGROUND

The applicant of this application had disclosed a linkage mechanism in U.S. 2017/0243704 A1. The linkage mechanism includes a left wing having two left arms, two left supporting rods that are respectively formed on the left arms, and two left sliding rods that are respectively formed on the left arms, a right wing having two right arms, two right supporting rods that are respectively formed on the right arms, and two right connecting rods that are respectively formed on the right arms, and a hinge unit having two left hinge pins, two right hinge pins, two left hinge holes and two right holes. Each left hinge hole is formed in a respective left arm and is engaged with a respective right hinge pin. Each right hinge hole is formed in a respective right arm and is engaged with a respective left hinge pin.

SUMMARY

An object of the disclosure is to provide a novel linkage assembly and a key switch device having the linkage assembly.

According to a first aspect of the disclosure, a linkage assembly is for guiding movement of a key cap in an upright direction relative to a support board between a normal position, which is distal from the support board, and a pressed position which is proximate to the support board. The linkage assembly includes a left modular linking member, a right modular linking member, and a pair of synchronizing units. The left modular linking member includes a pair of left arms and a left crosspiece. The left arms are spaced apart from each other in a front-to-rear direction. Each of the left arms extends in a left-to-right direction and includes a first power region, a first weight region, and a first fulcrum area. The first power region is configured for pivotally coupling with the key cap so as to move therewith in the upright direction. The first weight region is disposed rightwardly of the first power region. The first fulcrum area is disposed between the first weight region and the first power region, and is configured for pivotally coupling to the support board about a first moving axis in the front-to-rear direction, such that in response to downward movement of the key cap from the normal position to the pressed position, the first weight region is moved angularly and upwardly about the first moving axis, and such that in response to upward movement of the key cap from the pressed position to the normal position, the first weight region is moved angularly and downwardly about the first moving axis. The left crosspiece extends in the front-to-rear direction to interconnect the first power regions of the left arms. The right modular linking member includes a pair of right arms and a right crosspiece. The right arms are spaced apart from each other in the front-to-rear direction. Each of the right arms extends in the left-to-right direction and includes a second power region, a second weight region, and a second fulcrum area. The second power region is configured for pivotally coupling to the key cap so as to move therewith in the upright direction. The second weight region is disposed leftwardly of the second power region. The second fulcrum area is disposed between the second weight region and the second power region, and is configured for pivotally coupling to the support board about a second moving axis parallel to the first moving axis, such that in response to the downward movement of the key cap, the second weight region is moved angularly and upwardly about the second moving axis, and such that in response to the upward movement of the key cap, the second weight region is moved angularly and downwardly about the second moving axis. The right crosspiece extends in the front-to-rear direction to interconnect the second power regions of the right arms. Each of the synchronizing units is configured to couple the first weight region to the second weight region of a corresponding one of the right arms so as to synchronize movement of each of the left arms and a corresponding one of the right arms, and includes a first pin, a first hole, a second pin, and a second hole. The first pin extends from the first weight region of a corresponding one of the left arms along a first pin axis in the front-to-rear direction to terminate at a first end surface, and has a first outer tubular surface surrounding the first pin axis. The first pin has a first cutout region which extends from the first end surface toward the first weight region of the corresponding one of the left arms, and which extends inwardly from the first outer tubular surface toward the first pin axis to form a pair of first flat abutting surfaces that define a first predetermined included angle therebetween, and to form a first non-cutout region on the first outer tubular surface. The first non-cutout region has a first leading abutting area and a first trailing abutting area which are proximate to and distal from the first cutout region, respectively. The first hole is formed in the second weight region of a corresponding one of the right arms to have a size slightly larger than the first pin so as to permit the first pin to be rotatably retained therein. The first hole has a contour configured to have a first retaining contour portion and a first limiting contour portion. The first retaining contour portion has a pair of first flat abutted surfaces which are configured to substantially and respectively mate with the first flat abutting surfaces such that when the keycap is displaced to the normal position, the first flat abutting surfaces are brought into substantially full frictional engagement with the first flat abutted surfaces, respectively. The first limiting contour portion has a first leading abutted area and a first trailing abutted area which are distal from and proximate to the first retaining contour portion, respectively, such that in response to the downward movement of the key cap, the first leading and trailing abutting areas are brought into loose frictional engagement with the first trailing and leading abutted areas, respectively. The second pin extends from the second weight region of a corresponding one of the right arms along a second pin axis in the front-to-rear direction to terminate at a second end surface, and has a second outer tubular surface surrounding the second pin axis. The second pin has a second cutout region which extends from the second end surface toward the second weight region of the corresponding one of the right arms, and which extends inwardly from the second outer tubular surface toward the second pin axis to form a pair of second flat abutting surfaces that define a second predetermined included angle therebetween, and to form a second non-cutout region on the second outer tubular surface. The second non-cutout region has a second leading abutting area and a second trailing abutting area which are proximate to and distal from the second cutout region, respectively. The second hole is formed in the first weight region of a corresponding one of the left arms to have a size slightly larger than the second pin so as to permit the second pin to be rotatably retained therein. The second hole has a contour configured to have a second retaining contour portion and a second limiting contour portion. The second retaining contour portion has a pair of second flat abutted surfaces which are configured to substantially and respectively mate with the second flat abutting surfaces such that when the key cap is displaced to the normal position, the second flat abutting surfaces are brought into substantially full frictional engagement with the second flat abutted surfaces, respectively. The second limiting contour portion has a second leading abutted area and a second trailing abutted area which are distal from and proximate to the second retaining contour portion, respectively, such that in response to the downward movement of the key cap, the second leading and trailing abutting areas are brought into loose frictional engagement with the second trailing and leading abutted areas, respectively.

According to a second aspect of the disclosure, a key switch device includes a key cap, a support board, and a linkage assembly for guiding movement of the key cap in an upright direction relative to the support board between a normal position, which is distal from the support board, and a pressed position which is proximate to the support board. The linkage assembly includes a left modular linking member, a right modular linking member, and a pair of synchronizing units. The left modular linking member includes a pair of left arms and a left crosspiece. The left arms are spaced apart from each other in a front-to-rear direction. Each of the left arms extends in a left-to-right direction and includes a first power region, a first weight region, and a first fulcrum area. The first power region is configured for pivotally coupling with the key cap so as to move therewith in the upright direction. The first weight region is disposed rightwardly of the first power region. The first fulcrum area is disposed between the first weight region and the first power region, and is configured for pivotally coupling to the support board about a first moving axis in the front-to-rear direction, such that in response to downward movement of the key cap from the normal position to the pressed position, the first weight region is moved angularly and upwardly about the first moving axis, and such that in response to upward movement of the key cap from the pressed position to the normal position, the first weight region is moved angularly and downwardly about the first moving axis. The left crosspiece extends in the front-to-rear direction to interconnect the first power regions of the left arms. The right modular linking member includes a pair of right arms and a right crosspiece. The right arms are spaced apart from each other in the front-to-rear direction. Each of the right arms extends in the left-to-right direction and includes a second power region, a second weight region, and a second fulcrum area. The second power region is configured for pivotally coupling to the key cap so as to move therewith in the upright direction. The second weight region is disposed leftwardly of the second power region. The second fulcrum area is disposed between the second weight region and the second power region, and is configured for pivotally coupling to the support board about a second moving axis parallel to the first moving axis, such that in response to the downward movement of the key cap, the second weight region is moved angularly and upwardly about the second moving axis, and such that in response to the upward movement of the key cap, the second weight region is moved angularly and downwardly about the second moving axis. The right crosspiece extends in the front-to-rear direction to interconnect the second power regions of the right arms. Each of the synchronizing units is configured to couple the first weight region to the second weight region of a corresponding one of the right arms so as to synchronize movement of each of the left arms and a corresponding one of the right arms, and includes a first pin, a first hole, a second pin, and a second hole. The first pin extends from the first weight region of a corresponding one of the left arms along a first pin axis in the front-to-rear direction to terminate at a first end surface, and has a first outer tubular surface surrounding the first pin axis. The first pin has a first cutout region which extends from the first end surface toward the first weight region of the corresponding one of the left arms, and which extends inwardly from the first outer tubular surface toward the first pin axis to form a pair of first flat abutting surfaces that define a first predetermined included angle therebetween, and to form a first non-cutout region on the first outer tubular surface. The first non-cutout region has a first leading abutting area and a first trailing abutting area which are proximate to and distal from the first cutout region, respectively. The first hole is formed in the second weight region of a corresponding one of the right arms to have a size slightly larger than the first pin so as to permit the first pin to be rotatably retained therein. The first hole has a contour configured to have a first retaining contour portion and a first limiting contour portion. The first retaining contour portion has a pair of first flat abutted surfaces which are configured to substantially and respectively mate with the first flat abutting surfaces such that when the keycap is displaced to the normal position, the first flat abutting surfaces are brought into substantially full frictional engagement with the first flat abutted surfaces, respectively. The first limiting contour portion has a first leading abutted area and a first trailing abutted area which are distal from and proximate to the first retaining contour portion, respectively, such that in response to the downward movement of the key cap, the first leading and trailing abutting areas are brought into loose frictional engagement with the first trailing and leading abutted areas, respectively. The second pin extends from the second weight region of a corresponding one of the right arms along a second pin axis in the front-to-rear direction to terminate at a second end surface, and has a second outer tubular surface surrounding the second pin axis. The second pin has a second cutout region which extends from the second end surface toward the second weight region of the corresponding one of the right arms, and which extends inwardly from the second outer tubular surface toward the second pin axis to forma pair of second flat abutting surfaces that define a second predetermined included angle therebetween, and to form a second non-cutout region on the second outer tubular surface. The second non-cutout region has a second leading abutting area and a second trailing abutting area which are proximate to and distal from the second cutout region, respectively. The second hole is formed in the first weight region of a corresponding one of the left arms to have a size slightly larger than the second pin so as to permit the second pin to be rotatably retained therein. The second hole has a contour configured to have a second retaining contour portion and a second limiting contour portion. The second retaining contour portion has a pair of second flat abutted surfaces which are configured to substantially and respectively mate with the second flat abutting surfaces such that when the keycap is displaced to the normal position, the second flat abutting surfaces are brought into substantially full frictional engagement with the second flat abutted surfaces, respectively. The second limiting contour portion has a second leading abutted area and a second trailing abutted area which are distal from and proximate to the second retaining contour portion, respectively, such that in response to the downward movement of the key cap, the second leading and trailing abutting areas are brought into loose frictional engagement with the second trailing and leading abutted areas, respectively.

BRIEF DESCRIPTION OF THE DRAWINGS

Other features and advantages of the disclosure will become apparent in the following detailed description of the embodiment(s) with reference to the accompanying drawings, in which.

DETAILED DESCRIPTION

To aid in describing the disclosure, directional terms may be used in the specification and claims to describe portions of the present disclosure (e.g., front, rear, left, right, top, bottom, etc.). These directional definitions are intended to merely assist in describing and claiming the disclosure and are not intended to limit the disclosure in any way.

Referring to FIGS. 1, 4, 5, and 6, a key switch device according to an embodiment of the disclosure is shown to include a key cap 40, a support board 30, and a linkage assembly 5 for guiding movement of the key cap 40 in an upright direction (Z) between a normal position (FIG. 5), which is distal from the support board 30, and a pressed position (FIG. 6), which is proximate to the support board 30.

Figure 1:
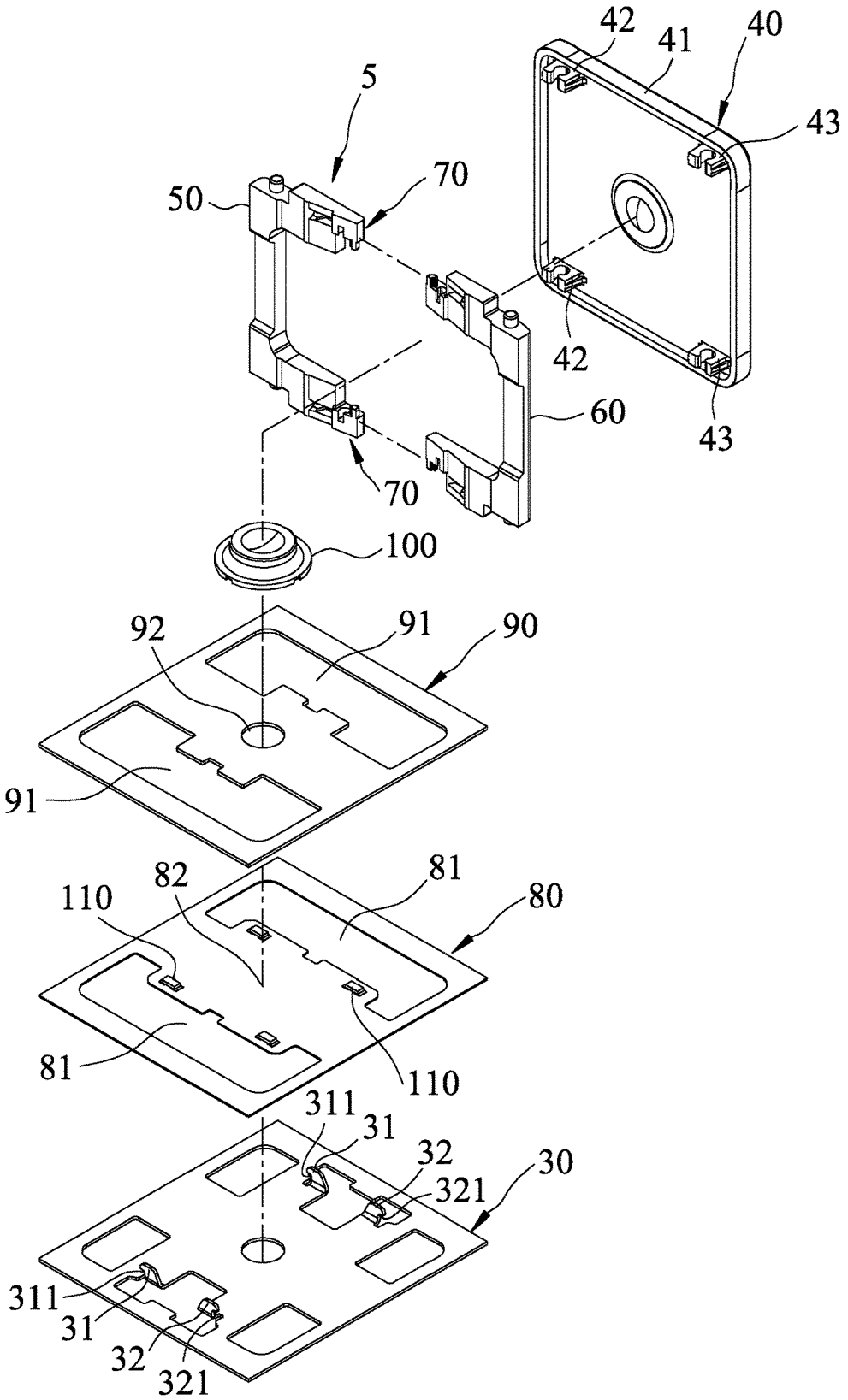
FIG. 1 is an exploded perspective view of a key switch device according to an embodiment of the disclosure.

In an embodiment shown in FIG. 1, the key cap 40 includes a cap body 41, a pair of left hingeably retaining members 42 formed on a lower surface of the cap body 41, and a pair of right hingeably retaining members 43 formed on the lower surface of the cap body 41.

In an embodiment shown in FIG. 1, the support board 30 includes a pair of left slidably retaining members 31 and a pair of right slidably retaining members 32. The left and right slidably retaining members 31, 32 are respectively formed by punching the support board 30 so as to have left and right retaining portions 311, 321.

Figure 2:
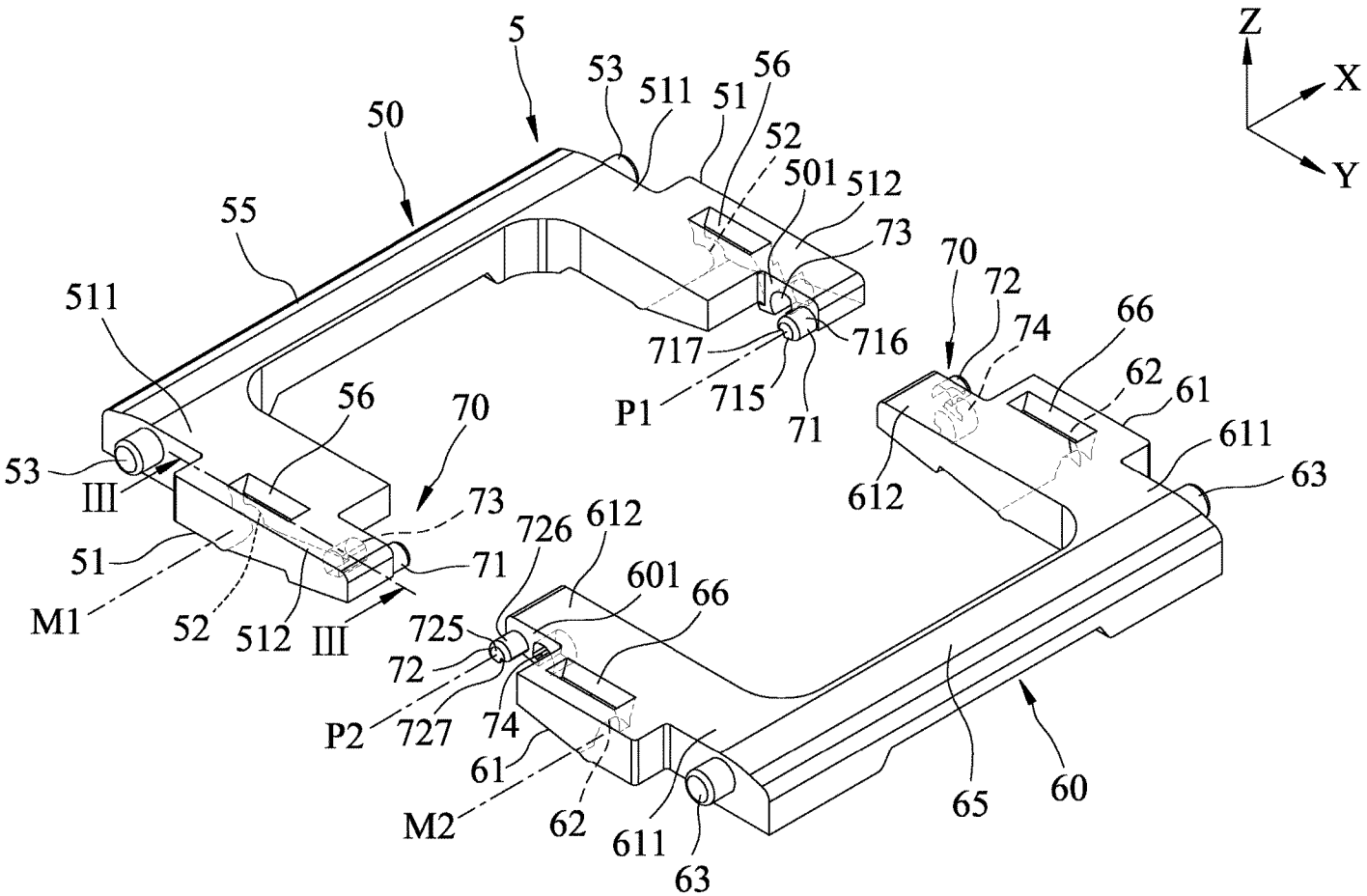
FIG. 2 is an enlarged view of left and right modular linking members of the key switch device.

As shown in FIG. 2, the linkage assembly 5 includes a left modular linking member 50, a right modular linking member 60, and a pair of synchronizing units 70.

The left modular linking member 50 includes a pair of left arms 51 and a left crosspiece 55.

The left arms 51 are spaced apart from each other in a front-to-rear direction (X). Each of the left arms 51 extends in a left-to-right direction (Y) and includes a first power region 511, a first weight region 512, and a first fulcrum area 52 disposed between the first weight region 512 and the first power region 511.

The first power region 511 is configured for pivotally coupling with the key cap 40 so as to move therewith in the upright direction (Z). In an embodiment shown in FIGS. 1 and 2, the first power region 511 is formed with a first retained finger 53 configured to be hingeably retained by a corresponding one of the left hingeably retaining members 42.

The first weight region 512 is disposed rightwardly of the first power region 511.

Figure 7:
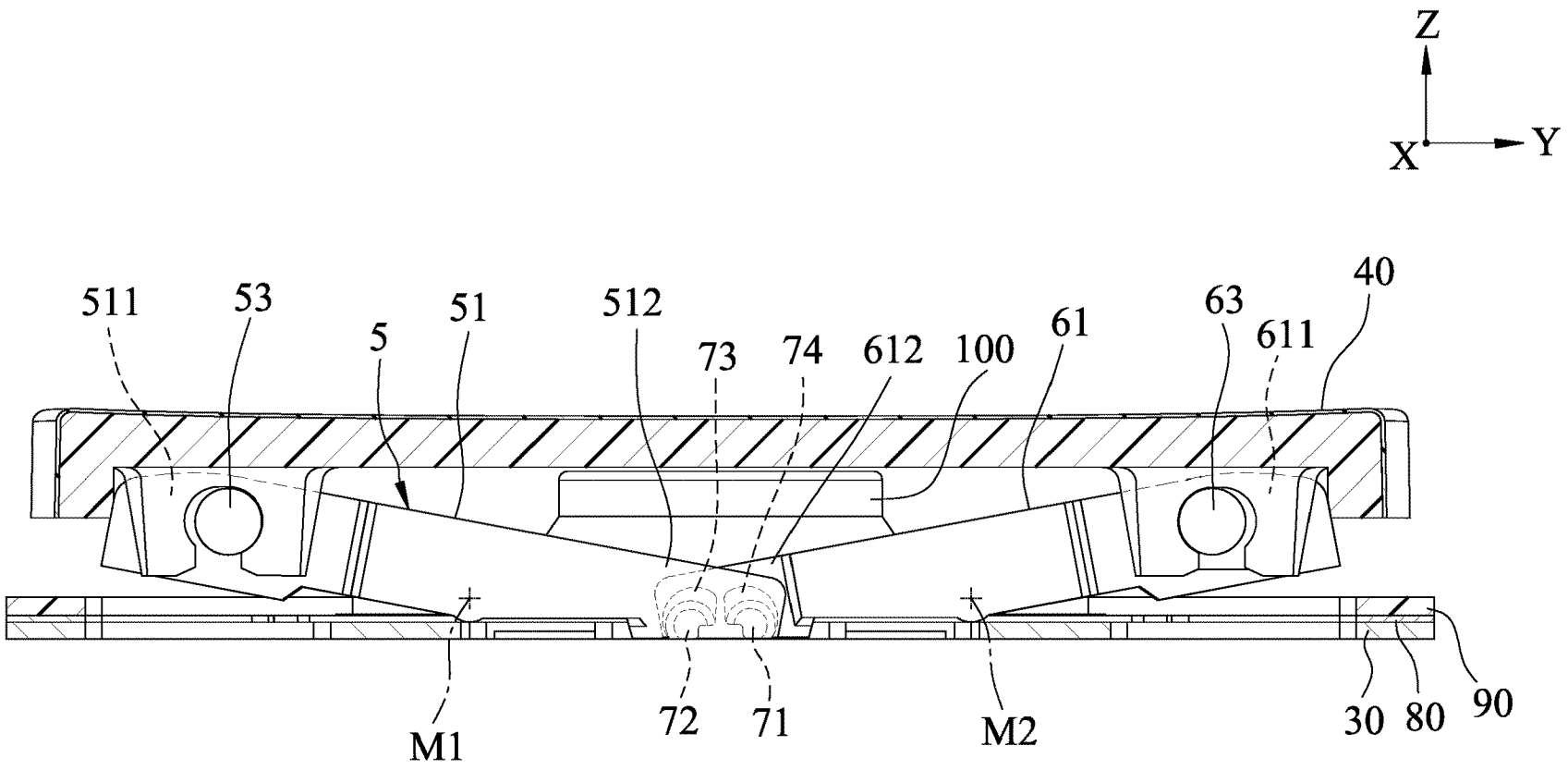
FIG. 7 is a partially sectioned view of the key switch device illustrating the key cap in a normal position.

The first fulcrum area 52 is configured for pivotally coupling to the support board 30 about a first moving axis (M1) in the front-to-rear direction (X). In response to downward movement of the key cap 40 from the normal position (FIGS. 5, 7, and 8) to the pressed position (FIGS. 6, 9, and 10), the first weight region 512 is moved angularly and upwardly about the first moving axis (M1) (i.e., the first weight region 512 is rotated about the first moving axis (M1) in a counterclockwise direction). In response to upward movement of the key cap 40 from the pressed position (FIGS. 6, 9, and 10) to the normal position (FIGS. 5, 7, and 8), the first weight region 512 is moved angularly and downwardly about the first moving axis (M1) (i.e., the first weight region 512 is rotated about the first moving axis (M1) in a clockwise direction).

Figure 3:
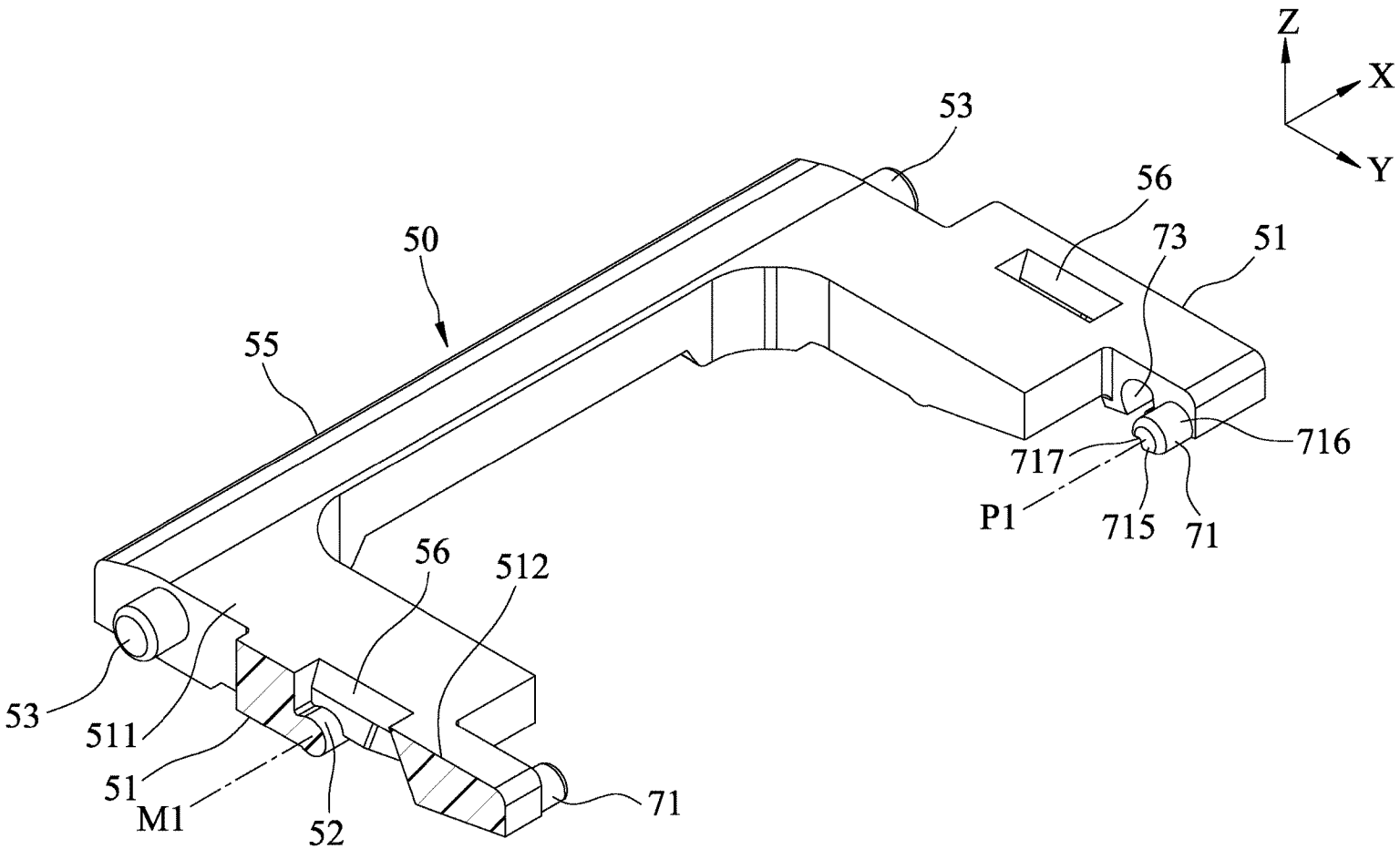
FIG. 3 is a cross-sectional view taken along line III-III of FIG. 2.
Figure 4:
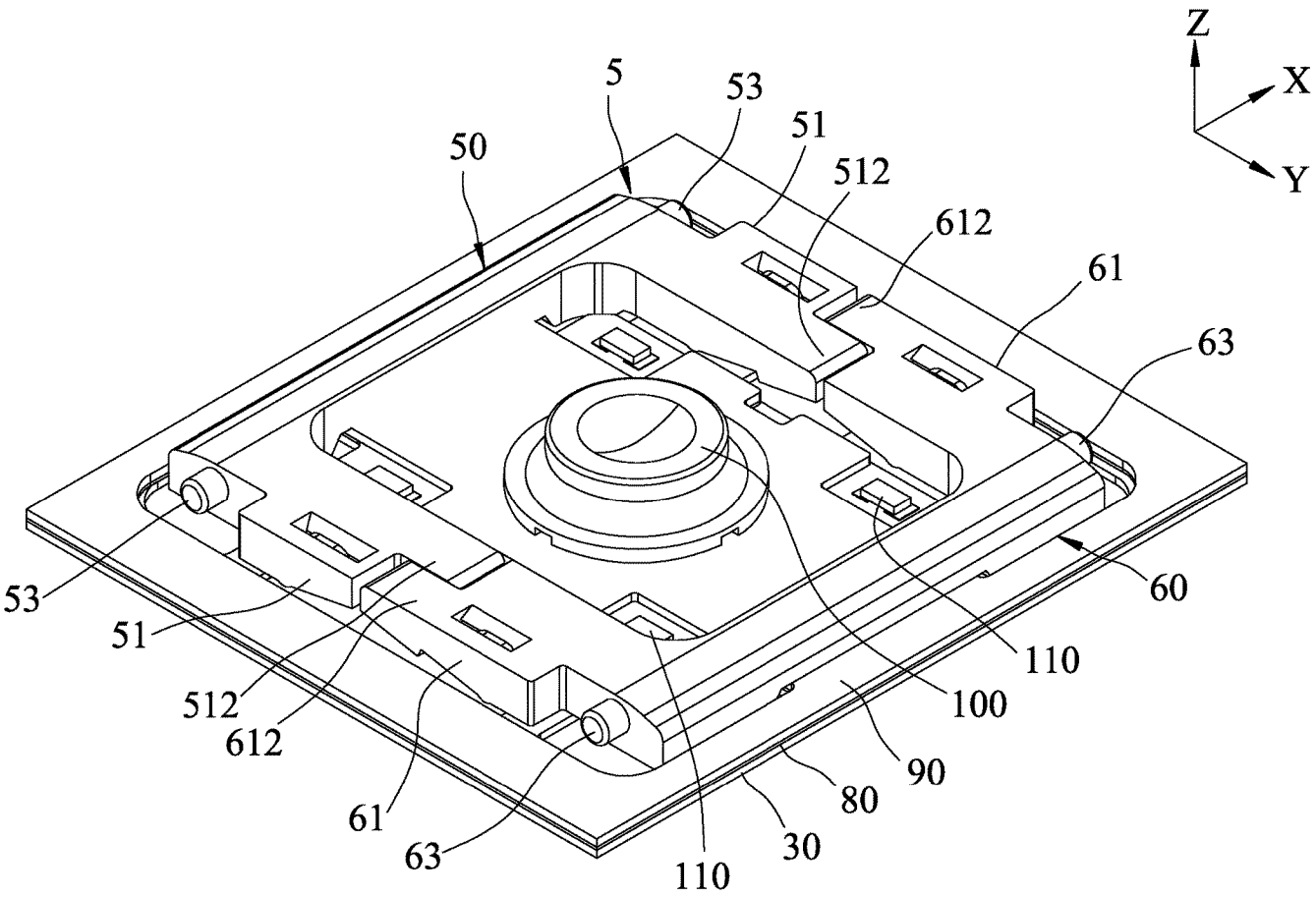
FIG. 4 is a perspective view of the key switch device of FIG. 1 in an assembled state, in which a key cap is omitted.
Figure 5:
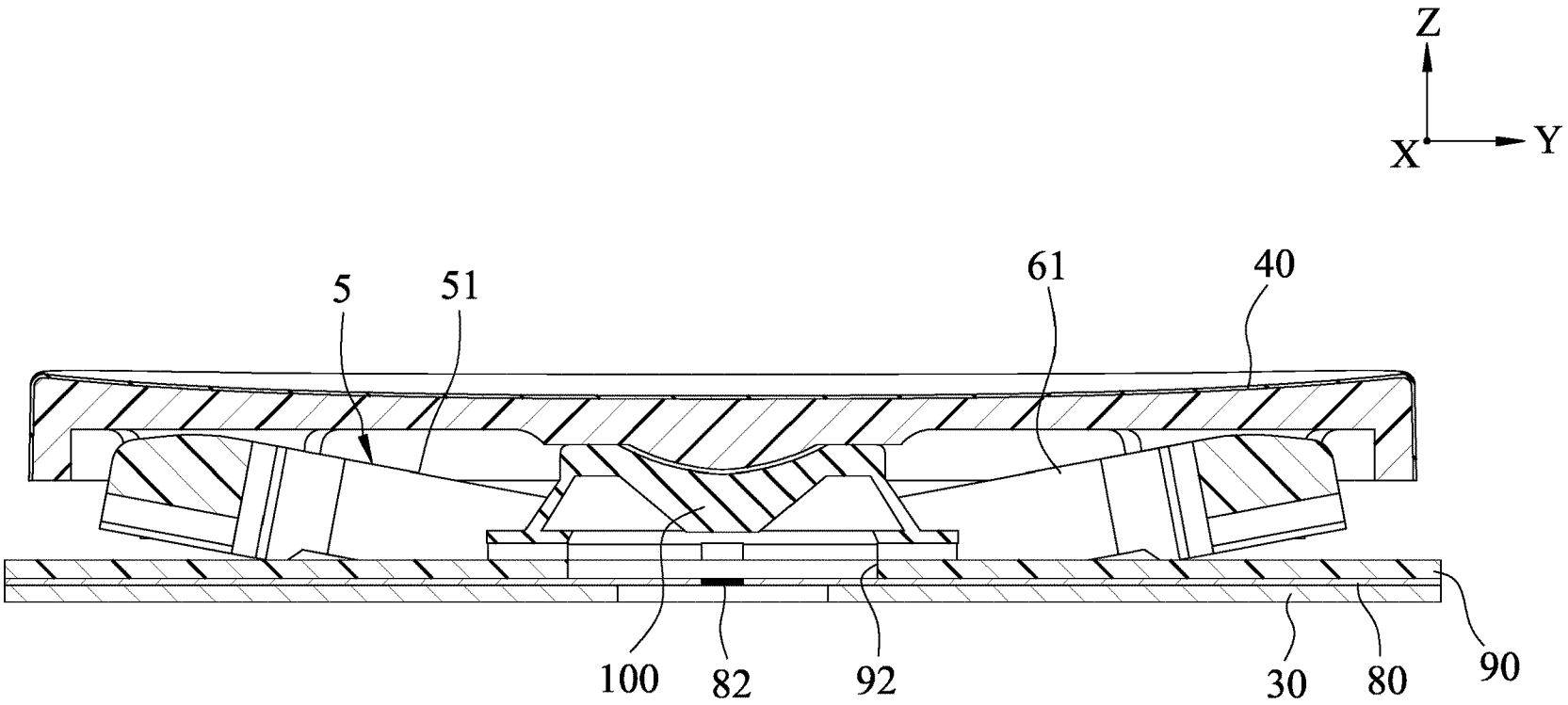
FIG. 5 is a cross-sectional view of the key switch device.
Figure 6:
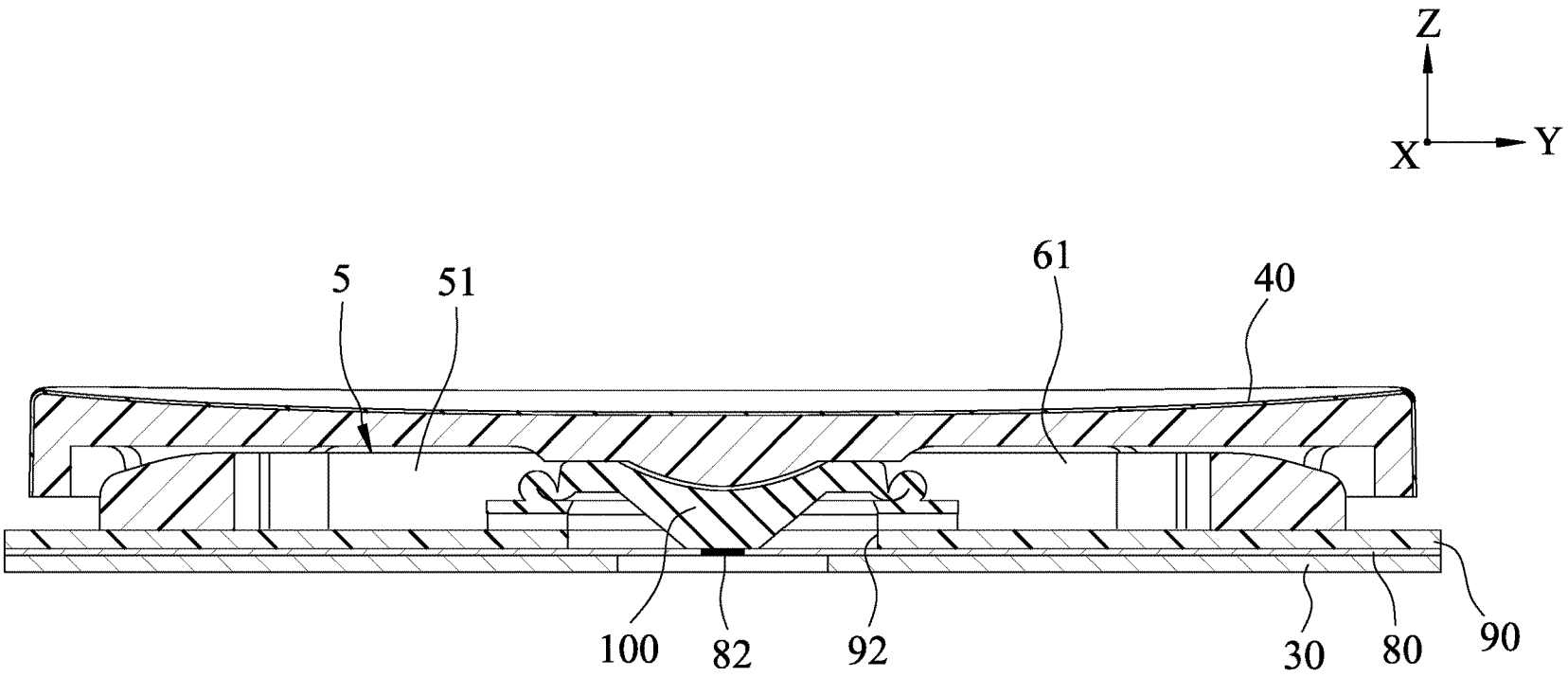
FIG. 6 is similar to FIG. 5 but illustrating the key cap in a pressed position.

In an embodiment shown in FIGS. 2 and 3, the first fulcrum area 52 is disposed in a first through bore 56 which is formed in a corresponding one of the left arms 51, and which is configured to receive a corresponding one of the left slidably retaining members 31 shown in FIG. 1. In a process of assembling, the left modular linking member 50 is disposed to permit the left slidably retaining members 31 to be respectively received in the first through bores 56 of the left arms 51, and then the left modular linking member 50 is moved rightwardly to permit the first fulcrum areas 52 of the left arms 51 to be slidably retained by the left retaining portions 311, respectively.

In other embodiments, the first fulcrum area 52 may be formed on an outer peripheral surface of a first fulcrum pin (not shown), and the first fulcrum pin may extend from an outboard of a corresponding one of the left arms 51 in the front-to-rear direction (X).

The left crosspiece 55 extends in the front-to-rear direction (X) to interconnect the first power regions 511 of the left arms 51.

Further referring to FIG. 2, the right modular linking member 60 is shown to include a pair of right arms 61 and a right crosspiece 65.

The right arms 61 are spaced apart from each other in the front-to-rear direction (X). Each of the right arms 61 extends in the left-to-right direction (Y) and includes a second power region 611, a second weight region 612, and a second fulcrum area 62 disposed between the second weight region 612 and the second power region 611.

The second power region 611 is configured for pivotally coupling to the key cap 40 so as to move therewith in the upright direction (Z). In an embodiment shown in FIGS. 1 and 2, the second power region 611 is formed with a second retained finger 63 configured to be hingeably retained by a corresponding one of the right hingeably retaining members 43.

The second weight region 612 is disposed leftwardly of the second power region 611.

The second fulcrum area 62 is configured for pivotally coupling to the support board 30 about a second moving axis (M2) parallel to the first moving axis (M1). In response to the downward movement of the key cap 40, as shown in FIGS. 7 to 10, the second weight region 612 is moved angularly and upwardly about the second moving axis (M2) (i.e., the second weight region 612 is rotated about the second moving axis (M2) in a clockwise direction). In response to the upward movement of the key cap 40, as shown in FIGS. 7 to 10, the second weight region 612 is moved angularly and downwardly about the second moving axis (M2) (i.e., the second weight region 612 is rotated about the second moving axis (M2) in a counterclockwise direction).

In an embodiment shown in FIG. 2, the second fulcrum area 62 is disposed in a second through bore 66 which is formed in a corresponding one of the right arms 61, and which is configured to receive a corresponding one of the right slidably retaining members 32 shown in FIG. 1. In a process of assembling, the right modular linking member 60 is disposed to permit the right slidably retaining members 32 to be respectively received in the first through bores 66 of the right arms 61, and then the right modular linking member 60 is moved leftwardly to permit the second fulcrum areas 62 of the right arms 61 to be slidably retained by the right retaining portions 321, respectively.

In other embodiments, the second fulcrum. area 62 may be formed on an outer peripheral surface of a second fulcrum. pin (not shown), and the second fulcrum pin may extend from an outboard of a corresponding one of the right arms 61 in the front-to-rear direction (X).

The right crosspiece 65 extends in the front-to-rear direction (X) to interconnect the second power regions 611 of the right arms 61.

Each of the synchronizing units 70 is configured to couple the first weight region 512 to the second weight region 612 of a corresponding one of the right arms 61 so as to synchronize movement of each of the left arms 51 and a corresponding one of the right arms 61. Each of the synchronizing units 70 includes a first pin 71, a first hole 74, a second pin 72, and a second hole 73.

As shown in FIGS. 2, 3, 8, and 10, the first pin 71 extends from the first weight region 512 of a corresponding one of the left arms 51 along a first pin axis (P1) in the front-to-rear direction (X) to terminate at a first end surface 715, and has a first outer tubular surface 716 surrounding the first pin axis (P1). The first pin 71 has a first cutout region 717 which extends from the first end surface 715 toward the first weight region 512 of the corresponding one of the left arms 51, and which extends inwardly from the first outer tubular surface 716 toward the first pin axis (P1) to form a pair of first flat abutting surfaces 713, 714 that define a first predetermined included angle therebetween, and to form a first non-cutout region 718 on the first outer tubular surface 716. The first non-cutout region 718 has a first leading abutting area 711 and a first trailing abutting area 712 which are proximate to and distal from the first cutout region 717, respectively.

Figure 8:
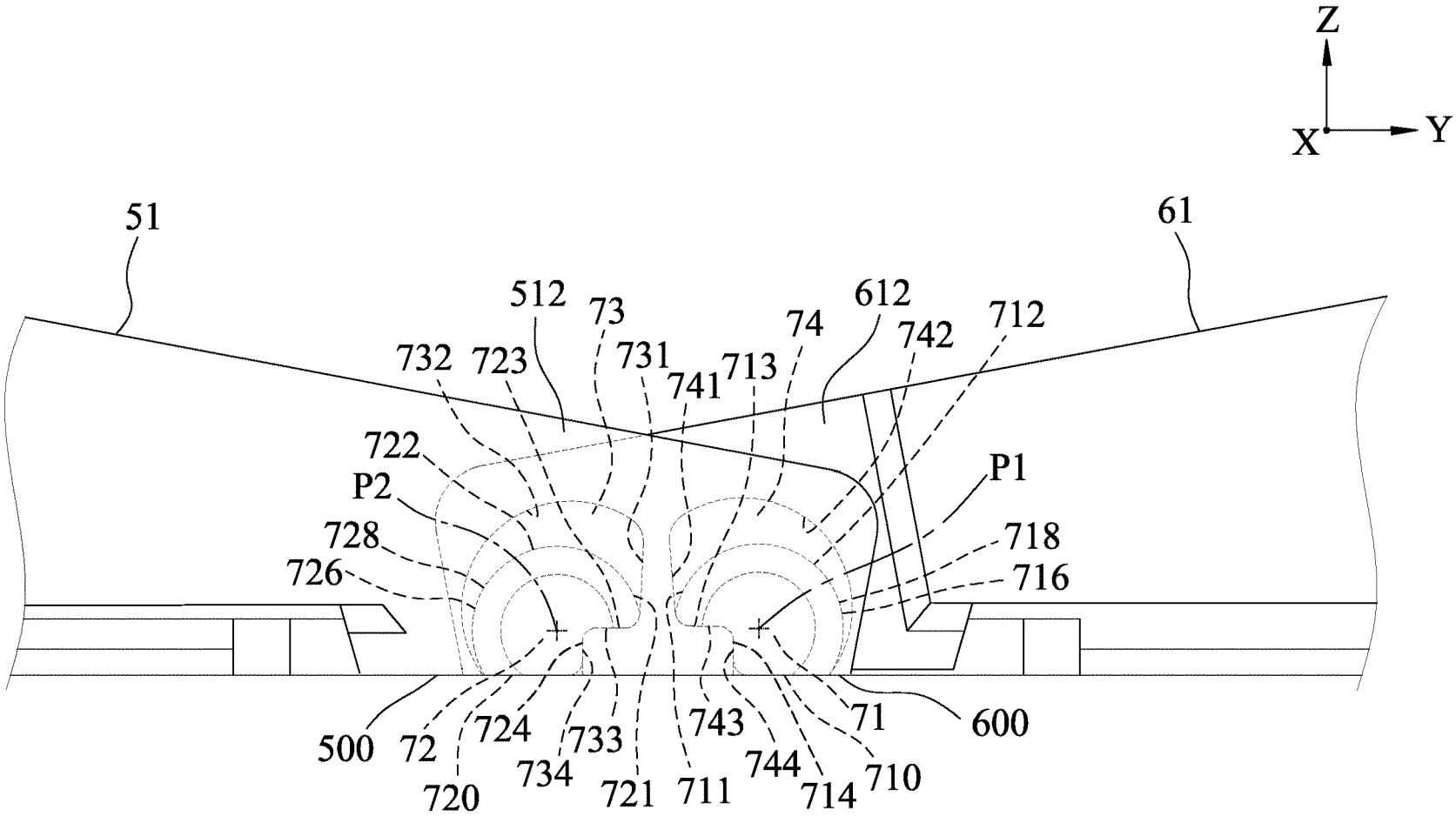
FIG. 8 is a fragmentary enlarged view of FIG. 7.
Figure 9:
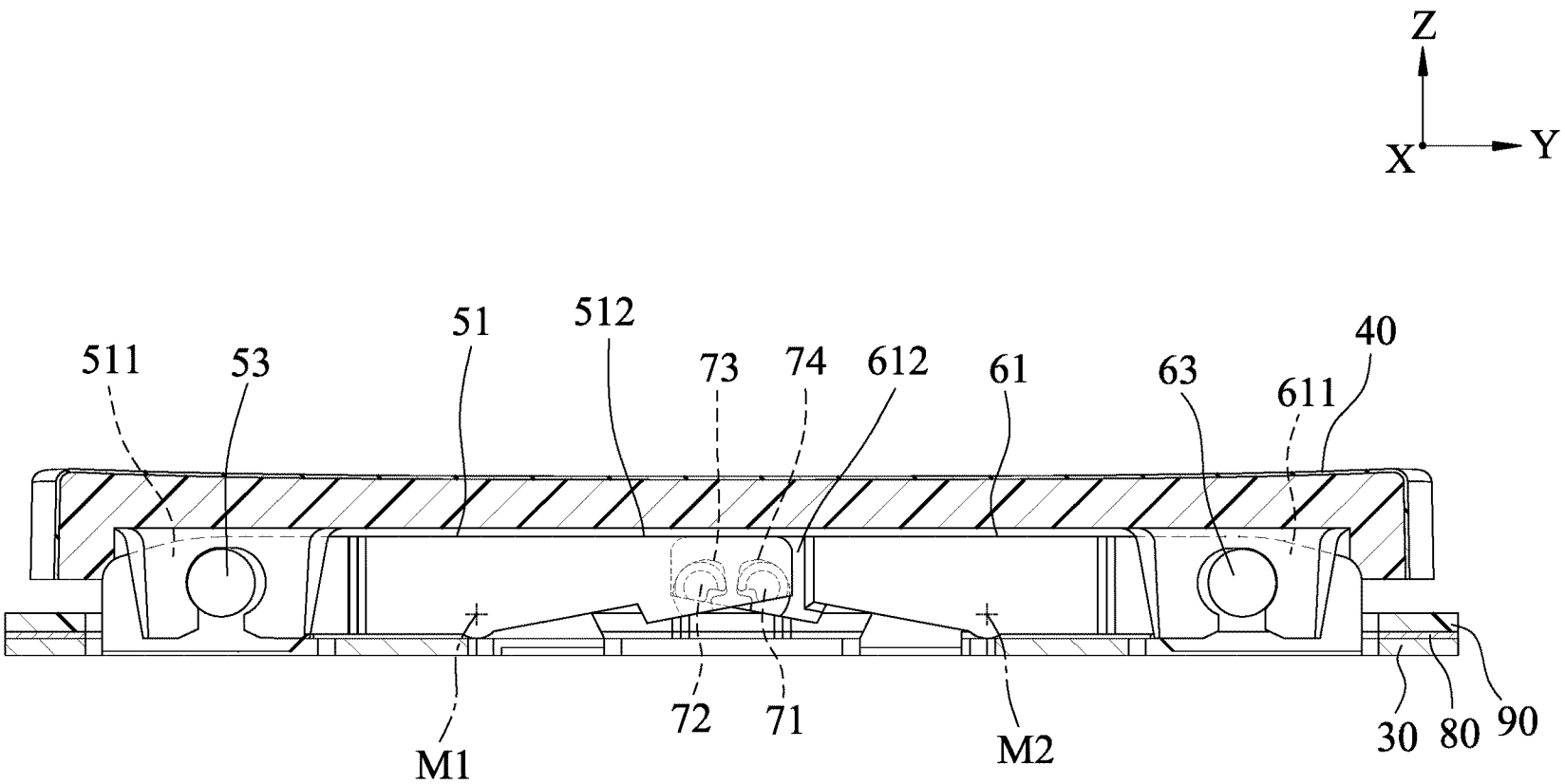
FIG. 9 is similar to FIG. 7 but illustrating the key cap in the pressed position.
Figure 10:
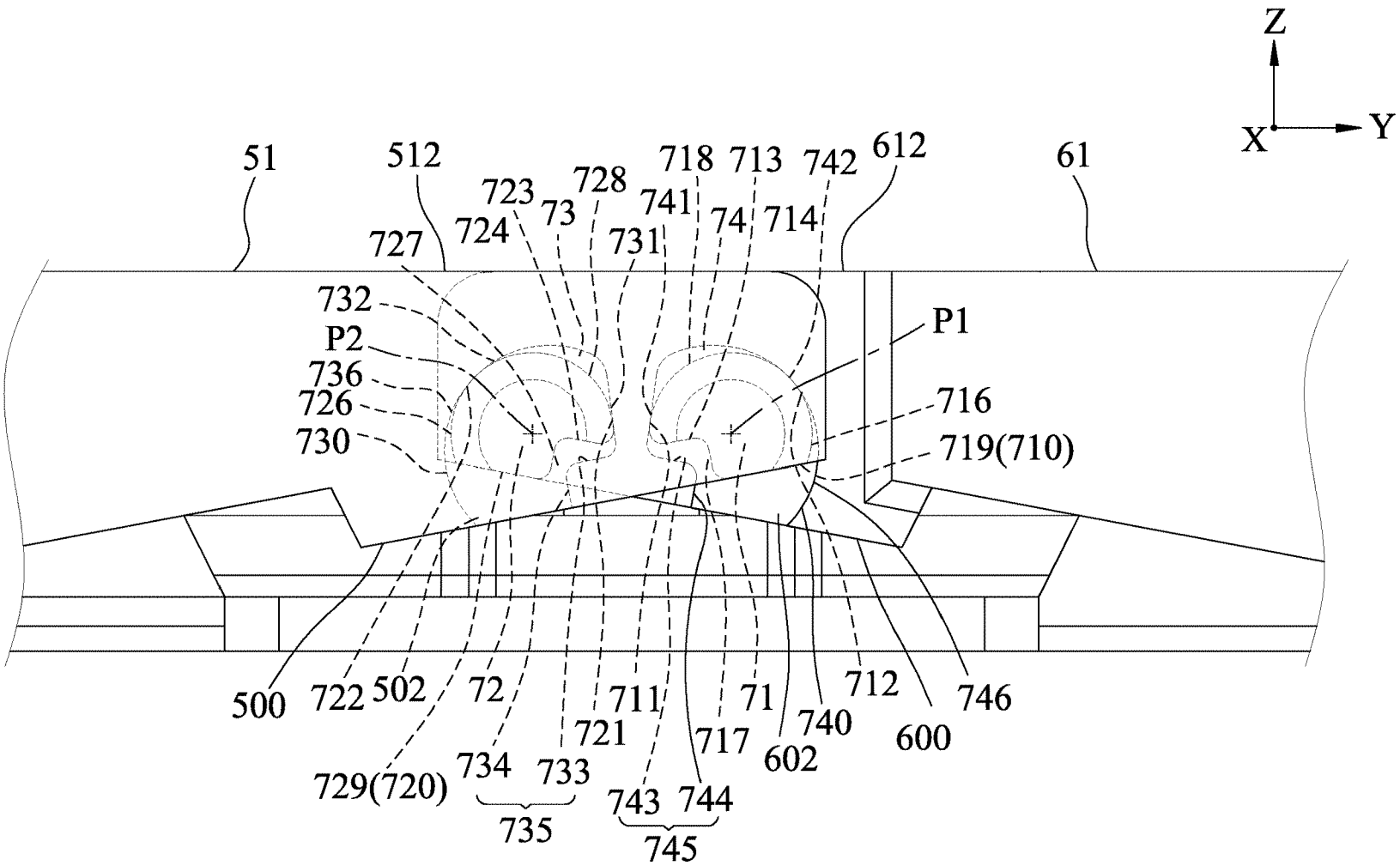
FIG. 10 is a fragmentary enlarged view of FIG. 9.

In an embodiment shown in FIGS. 8 and 10, the first predetermined included angle is substantially 90°.

As shown in FIGS. 2, 8, and 10, the first hole 74 is formed in the second weight region 612 of a corresponding one of the right arms 61 to have a size slightly larger than the first pin 71 so as to permit the first pin 71 to be rotatably retained therein. The first hole 74 has a contour 740 configured to have a first retaining contour portion 745 and a first limiting contour portion 746 (see FIG. 10).

The first retaining contour portion 745 has a pair of first flat abutted surfaces 743, 744 which are configured to substantially and respectively mate with the first flat abutting surfaces 713, 714 such that when the key cap 40 is displaced to the normal position (FIGS. 7 and 8), the first flat abutting surfaces 713, 714 are brought into substantially full frictional engagement with the first flat abutted surfaces 743, 744, respectively.

The first limiting contour portion 746 has a first leading abutted area 742 and a first trailing abutted area 741 which are distal from and proximate to the first retaining contour portion 745, respectively, such that in response to the downward movement of the key cap 40, the first leading and trailing abutting areas 711, 712 are brought into loose frictional engagement with the first trailing and leading abutted areas 741, 742, respectively (see FIG. 10).

As shown in FIGS. 2, 8, and 10, the second pin 72 extends from the second weight region 612 of a corresponding one of the right arms 61 along a second pin axis (P2) in the front-to-rear direction (X) to terminate at a second end surface 725, and has a second outer tubular surface 726 surrounding the second pin axis (P2). The second pin 72 has a second cutout region 727 which extends from the second end surface 725 toward the second weight region 612 of the corresponding one of the right arms 61, and which extends inwardly from the second outer tubular surface 726 toward the second pin axis (P2) to form a pair of second flat abutting surfaces 723, 724 that define a second predetermined included angle therebetween, and to form a second non-cutout region 728 on the second outer tubular surface 726. The second non-cutout region 728 has a second leading abutting area 721 and a second trailing abutting area 722 which are proximate to and distal from the second cutout region 727, respectively.

In an embodiment shown in FIGS. 8 and 10, the second predetermined included angle is substantially 90°.

As shown in FIGS. 2, 3, 8, and 10, the second hole 73 is formed in the first weight region 512 of a corresponding one of the left arms 51 to have a size slightly larger than the second pin 72 so as to permit the second pin 72 to be rotatably retained therein. The second hole 73 has a contour 730 configured to have a second retaining contour portion 735 and a second limiting contour portion 736 (see FIG. 10).

The second retaining contour portion 735 has a pair of second flat abutted surfaces 733, 734 which are configured to substantially and respectively mate with the second flat abutting surfaces 723, 724 such that when the keycap 40 is displaced to the normal position (FIGS. 7 and 8), the second flat abutting surfaces 723, 724 are brought into substantially full frictional engagement with the second flat abutted surfaces 733, 734, respectively.

The second limiting contour portion 736 has a second leading abutted area 732 and a second trailing abutted area 731 which are distal from and proximate to the second retaining contour portion 735, respectively, such that in response to the downward movement of the key cap 40, the second leading and trailing abutting areas 721, 722 are brought into loose frictional engagement with the second trailing and leading abutted areas 731, 732, respectively (see FIG. 10).

In this embodiment, when the key cap 40 is displaced to the normal position, the first flat abutting surfaces 713, 714 and the second flat abutting surfaces 723, 724 are brought into substantially full frictional engagement with the first flat abutted surfaces 743, 744, and the second flat abutted surfaces 733, 734, respectively. In this case, the key cap 40 may be more precisely displaced to the normal position and is less likely to shift in the left-to-right direction (Y).

In an embodiment shown in FIGS. 2 and 3, the first pin 71 extends from an inboard surface 501 of the first weight region 512 of a corresponding one of the left arms 51, the first hole 74 is formed in an outboard surface 601 of the second weight region 612 of a corresponding one of the right arms 61, the second pin 72 extends from the outboard surface 601 of the second weight region 612 of a corresponding one of the right arms 61, and the second hole 73 is formed in the inboard surface 501 of the first weight region 512 of a corresponding one of the left arms 51.

In an embodiment illustrated in FIG. 2, the first pin 71 and the second hole 73 are disposed distal from and proximate to the first fulcrum area 52 of a corresponding one of the left arms 51, respectively, and the second pin 72 and the first hole 74 are disposed distal from and proximate to the second fulcrum area 62 of a corresponding one of the right arms 61, respectively.

In other embodiments, the first pin and the second hole may be disposed proximate to and distal from the first fulcrum. area 52 of a corresponding one of the left arms 51, respectively, and the second pin and the first hole may be disposed proximate to and distal from the second fulcrum area 62 of a corresponding one of the right arms 61, respectively.

In an embodiment shown in FIG. 2, the first weight region 512 is cut to form the inboard surface 501, and the second weight region 612 is cut to form the outboard surface 601 for confronting the inboard surface 501 of a corresponding one of the left arms 51.

As shown in an embodiment shown in FIG. 10, the first weight region 512 has a first lower surface 500 formed with a first slot 502 extending upwardly to communicate to the second hole 73 of a corresponding one of the synchronizing units 70, and the second weight region 612 has a second lower surface 600 formed with a second slot 602 extending upwardly to communicate to the first hole 74 of a corresponding one of the synchronizing units 70.

In addition, the first pin 71 has a third cutout region 719 with a third flat surface 710 which is substantially parallel to a distal one of the first flat abutting surfaces 713, 714, such that when the key cap 40 is displaced to the normal position (FIGS. 7 and 8), the third flat surface 710 is displaced to be substantially flush with the second lower surface 600 of the second weight region 612 of a corresponding one of the right arms 61.

Furthermore, the second pin 72 has a fourth cutout region 729 with a fourth flat surface 720 which is substantially parallel to a distal one of the second flat abutting surfaces 723, 724, such that when the key cap 40 is displaced to the normal position (FIGS. 7 and 8), the fourth flat surface 720 is displaced to be substantially flush with the first lower surface 500 of the first weight region 512 of a corresponding one of the left arms 51.

In this embodiment, when the key cap 40 is displaced to the normal position, the third flat surface 710 and the fourth flat surface 720 are displaced to be substantially flush with the respective second and first lower surfaces 600, 500, respectively. In this case, the operation of the key switch device is more stable, and the key cap 40 may be more precisely displaced to the normal position and is less likely to shift in the left-to-right direction (Y).

In an embodiment shown in FIG. 1, the key switch device may further include a circuit board 80, an insulating film 90, and an actuating member 100.

The circuit board 80 is disposed on the support board 30 and has a plurality of first openings 81 configured to permit the first and second fulcrum areas 52, 62 of the left and right arms 51, 61 access to the support board 30. The circuit board 80 has an electric contact 82. In other embodiments, the circuit board 80 may be a membrane circuit or a printed circuit board.

The insulating film 90 is disposed on the circuit board 80, and has a plurality of second openings 91 which are in line with the first openings 81 to permit the first and second fulcrum areas 52, 62 of the left and right arms 51, 61 access to the support board 30. The insulating film 90 further has a central hole 92 for access to the electric contact 82.

The actuating member 100 is elastically deformable and is disposed between the key cap 40 and the insulating film 90 to bias the key cap 40 to the normal position, such that in response to the downward movement of the key cap 40, the actuating member 100 is displaced to trigger the electric contact 82 for producing an electric signal. The actuating member 100 may be any elements for providing a biasing force, such as a rubber dome, a coil spring, etc.

In an embodiment shown in FIG. 1, the key switch device may further include a plurality of light-emitting members 110 which are disposed on the circuit board 80 and which are electrically connected to circuitry in the circuit board 80. The light-emitting members 110 may be light-emitting diodes or the like.

In the description above, for the purposes of explanation, numerous specific details have been set forth in order to provide a thorough understanding of the embodiment(s). It will be apparent, however, to one skilled in the art, that one or more other embodiments maybe practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is (are) considered the exemplary embodiment (s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A linkage assembly for guiding movement of a key cap in an upright direction relative to a support board between a normal position, which is distal from the support board, and a pressed position which is proximate to the support board, said linkage assembly comprising:

a left modular linking member including a pair of left arms which are spaced apart from each other in a front-to-rear direction, each of said left arms extending in a left-to-right direction and including a first power region configured for pivotally coupling with the key cap so as to move therewith in the upright direction, a first weight region disposed rightwardly of said first power region, and a first fulcrum area which is disposed between said first weight region and said first power region, and which is configured for pivotally coupling to the support board about a first moving axis in the front-to-rear direction, such that in response to downward movement of the key cap from the normal position to the pressed position, said first weight region is moved angularly and upwardly about the first moving axis, and such that in response to upward movement of the key cap from the pressed position to the normal position, said first weight region is moved angularly and downwardly about the first moving axis, and a left crosspiece extending in the front-to-rear direction to interconnect said first power regions of said left arms;

a right modular linking member including a pair of right arms which are spaced apart from each other in the front-to-rear direction, each of said right arms extending in the left-to-right direction and including a second power region configured for pivotally coupling to the key cap so as to move therewith in the upright direction, a second weight region disposed leftwardly of said second power region, and a second fulcrum area which is disposed between said second weight region and said second power region, and which is configured for pivotally coupling to the support board about a second moving axis parallel to the first moving axis, such that in response to the downward movement of the key cap, said second weight region is moved angularly and upwardly about the second moving axis, and such that in response to the upward movement of the key cap, said second weight region is moved angularly and downwardly about the second moving axis, and a right crosspiece extending in the front-to-rear direction to interconnect said second power regions of said right arms; and a pair of synchronizing units each of which is configured to couple said first weight region to said second weight region of a corresponding one of said right arms so as to synchronize movement of each of said left arms and a corresponding one of said right arms, and each of which includes a first pin which extends from said first weight region of a corresponding one of said left arms along a first pin axis in the front-to-rear direction to terminate at a first end surface, and which has a first outer tubular surface surrounding the first pin axis, said first pin having a first cutout region which extends from said first end surface toward said first weight region of the corresponding one of said left arms, and which extends inwardly from said first outer tubular surface toward the first pin axis to form a pair of first flat abutting surfaces that define a first predetermined included angle therebetween, and to form a first non-cutout region on said first outer tubular surface, said first non-cutout region having a first leading abutting area and a first trailing abutting area which are proximate to and distal from said first cutout region, respectively, a first hole which is formed in said second weight region of a corresponding one of said right arms being larger than said first pin so as to permit said first pin to be rotatably retained therein, said first hole having a contour configured to have a first retaining contour portion having a pair of first flat abutted surfaces which are configured to substantially and respectively mate with said first flat abutting surfaces such that when the key cap is displaced to the normal position, said first flat abutting surfaces are brought into substantially full frictional engagement with said first flat abutted surfaces, respectively, and a first limiting contour portion having a first leading abutted area and a first trailing abutted area which are distal from and proximate to said first retaining contour portion, respectively, such that in response to the downward movement of the key cap, said first leading and trailing abutting areas are brought into loose frictional engagement with said first trailing and leading abutted areas, respectively, a second pin which extends from said second weight region of a corresponding one of said right arms along a second pin axis in the front-to-rear direction to terminate at a second end surface, and which has a second outer tubular surface surrounding the second pin axis, said second pin having a second cutout region which extends from said second end surface toward said second weight region of the corresponding one of said right arms, and which extends inwardly from said second outer tubular surface toward the second pin axis to forma pair of second flat abutting surfaces that define a second predetermined included angle therebetween, and to form a second non-cutout region on said second outer tubular surface, said second non-cutout region having a second leading abutting area and a second trailing abutting area which are proximate to and distal from said second cutout region, respectively, and a second hole which is formed in said first weight region of a corresponding one of said left arms being larger than said second pin so as to permit said second pin to be rotatably retained therein, said second hole having a contour configured to have a second retaining contour portion having a pair of second flat abutted surfaces which are configured to substantially and respectively mate with said second flat abutting surfaces such that when the key cap is displaced to the normal position, said second flat abutting surfaces are brought into substantially full frictional engagement with said second flat abutted surfaces, respectively, and a second limiting contour portion having a second leading abutted area and a second trailing abutted area which are distal from and proximate to said second retaining contour portion, respectively, such that in response to the downward movement of the key cap, said second leading and trailing abutting areas are brought into loose frictional engagement with said second trailing and leading abutted areas, respectively.

2. The linkage assembly as claimed in claim 1, wherein: said first pin extends from an inboard surface of said first weight region of a corresponding one of said left arms;

said first hole is formed in an outboard surface of said second weight region of a corresponding one of said right arms;

said second pin extends from said outboard surface of said second weight region of a corresponding one of said right arms; and said second hole is formed in said inboard surface of said first weight region of a corresponding one of said left arms.

3. The linkage assembly as claimed in claim 2, wherein said first pin and said second hole are disposed distal from and proximate to said first fulcrum area of a corresponding one of said left arms, respectively, and said second pin and said first hole are disposed distal from and proximate to said second fulcrum area of a corresponding one of said right arms, respectively.

4. The linkage assembly as claimed in claim 1, wherein each of said first and second predetermined included angles is substantially 90°.

5. The linkage assembly as claimed in claim 4, wherein:

said first weight region has a first lower surface formed with a first slot extending upwardly to communicate to said second hole of a corresponding one of said synchronizing units;

said second weight region has a second lower surface formed with a second slot extending upwardly to communicate to said first hole of a corresponding one of said synchronizing units;

said first pin has a third cutout region with a third flat surface which is substantially parallel to a distal one of said first flat abutting surfaces, such that when the key cap is displaced to the normal position, said third flat surface is displaced to be substantially flush with said second lower surface of said second weight region of a corresponding one of said right arms; and said second pin has a fourth cutout region with a fourth flat surface which is substantially parallel to a distal one of said second flat abutting surfaces, such that when the key cap is displaced to the normal position, said fourth flat surface is displaced to be substantially flush with said first lower surface of said first weight region of a corresponding one of said left arms.

6. A key switch device comprising a key cap, a support board, and a linkage assembly for guiding movement of said key cap in an upright direction relative to said support board between a normal position, which is distal from said support board, and a pressed position which is proximate to said support board, said linkage assembly including:

a left modular linking member including a pair of left arms which are spaced apart from each other in a front-to-rear direction, each of said left arms extending in a left-to-right direction and including a first power region configured for pivotally coupling with said key cap so as to move therewith in the upright direction, a first weight region disposed rightwardly of said first power region, and a first fulcrum area which is disposed between said first weight region and said first power region, and which is configured for pivotally coupling to said support board about a first moving axis in the front-to-rear direction, such that in response to downward movement of said key cap from the normal position to the pressed position, said first weight region is moved angularly and upwardly about the first moving axis, and such that in response to upward movement of said key cap from the pressed position to the normal position, said first weight region is moved angularly and downwardly about the first moving axis, and a left crosspiece extending in the front-to-rear direction to interconnect said first power regions of said left arms;

a right modular linking member including a pair of right arms which are spaced apart from each other in the front-to-rear direction, each of said right arms extending in the left-to-right direction and including a second power region configured for pivotally coupling to said key cap so as to move therewith in the upright direction, a second weight region disposed leftwardly of said second power region, and a second fulcrum area which is disposed between said second weight region and said second power region, and which is configured for pivotally coupling to said support board about a second moving axis parallel to the first moving axis, such that in response to the downward movement of said key cap, said second weight region is moved angularly and upwardly about the second moving axis, and such that in response to the upward movement of said key cap, said second weight region is moved angularly and downwardly about the second moving axis, and a right crosspiece extending in the front-to-rear direction to interconnect said second power regions of said right arms; and a pair of synchronizing units each of which is configured to couple said first weight region to said second weight region of a corresponding one of said right arms so as to synchronize movement of each of said left arms and a corresponding one of said right arms, and each of which includes a first pin which extends from said first weight region of a corresponding one of said left arms along a first pin axis in the front-to-rear direction to terminate at a first end surface, and which has a first outer tubular surface surrounding the first pin axis, said first pin having a first cutout region which extends from said first end surface toward said first weight region of the corresponding one of said left arms, and which extends inwardly from said first outer tubular surface toward the first pin axis to form a pair of first flat abutting surfaces that define a first predetermined included angle therebetween, and to form a first non-cutout region on said first outer tubular surface, said first non-cutout region having a first leading abutting area and a first trailing abutting area which are proximate to and distal from said first cutout region, respectively, a first hole which is formed in said second weight region of a corresponding one of said right arms being larger than said first pin so as to permit said first pin to be rotatably retained therein, said first hole having a contour configured to have a first retaining contour portion having a pair of first flat abutted surfaces which are configured to substantially and respectively mate with said first flat abutting surfaces such that when said key cap is displaced to the normal position, said first flat abutting surfaces are brought into substantially full frictional engagement with said first flat abutted surfaces, respectively, and a first limiting contour portion having a first leading abutted area and a first trailing abutted area which are distal from and proximate to said first retaining contour portion, respectively, such that in response to the downward movement of said key cap, said first leading and trailing abutting areas are brought into loose frictional engagement with said first trailing and leading abutted areas, respectively, a second pin which extends from said second weight region of a corresponding one of said right arms along a second pin axis in the front-to-rear direction to terminate at a second end surface, and which has a second outer tubular surface surrounding the second pin axis, said second pin having a second cutout region which extends from said second end surface toward said second weight region of the corresponding one of said right arms, and which extends inwardly from said second outer tubular surface toward the second pin axis to form a pair of second flat abutting surfaces that define a second predetermined included angle therebetween, and to form a second non-cutout region on said second outer tubular surface, said second non-cutout region having a second leading abutting area and a second trailing abutting area which are proximate to and distal from said second cutout region, respectively, and a second hole which is formed in said first weight region of a corresponding one of said left arms being larger than said second pin so as to permit said second pin to be rotatably retained therein, said second hole having a contour configured to have a second retaining contour portion having a pair of second flat abutted surfaces which are configured to substantially and respectively mate with said second flat abutting surfaces such that when said key cap is displaced to the normal position, said second flat abutting surfaces are brought into substantially full frictional engagement with said second flat abutted surfaces, respectively, and a second limiting contour portion having a second leading abutted area and a second trailing abutted area which are distal from and proximate to said second retaining contour portion, respectively, such that in response to the downward movement of said key cap, said second leading and trailing abutting areas are brought into loose frictional engagement with said second trailing and leading abutted areas, respectively.

7. The key switch device as claimed in claim 6, wherein:

said first pin extends from an inboard surface of said first weight region of a corresponding one of said left arms;

said first hole is formed in an outboard surface of said second weight region of a corresponding one of said right arms;

said second pin extends from said outboard surface of said second weight region of a corresponding one of said right arms; and said second hole is formed in said inboard surface of said first weight region of a corresponding one of said left arms.

8. The key switch device as claimed in claim 7, wherein said first pin and said second hole are disposed distal from and proximate to said first fulcrum area of a corresponding one of said left arms, respectively, and said second pin and said first hole are disposed distal from and proximate to said second fulcrum area of a corresponding one of said right arms, respectively.

9. The key switch device as claimed in claim 6, wherein each of said first and second predetermined included angles is substantially 90°.

10. The key switch device as claimed in claim 9, wherein:

said first weight region has a first lower surface formed with a first slot extending upwardly to communicate to said second hole of a corresponding one of said synchronizing units;

said second weight region has a second lower surface formed with a second slot extending upwardly to communicate to said first hole of a corresponding one of said synchronizing units;

said first pin has a third cutout region with a third flat surface which is substantially parallel to a distal one of said first flat abutting surfaces, such that when said key cap is displaced to the normal position, said third flat surface is displaced to be substantially flush with said second lower surface of said second weight region of a corresponding one of said right arms; and said second pin has a fourth cutout region with a fourth flat surface which is substantially parallel to a distal one of said second flat abutting surfaces, such that when said key cap is displaced to the normal position, said fourth flat surface is displaced to be substantially flush with said first lower surface of said first weight region of a corresponding one of said left arms.

11. The key switch device as claimed in claim 6, further comprising:

a circuit board which is disposed on said support board and which has a plurality of first openings configured to permit said first and second fulcrum areas of said left and right arms access to said support board, said circuit board having an electric contact;

an insulating film disposed on said circuit board, and having a plurality of second openings which are in line with said first openings to permit said first and second fulcrum areas of said left and right arms access to said support board, said insulating film further having a central hole for access to said electric contact; and an actuating member which is elastically deformable and which is disposed between said key cap and said insulating film to bias said key cap to the normal position, such that in response to the downward movement of said key cap, said actuating member is displaced to trigger said electric contact for producing an electric signal.

12. The key switch device as claimed in claim 11, further comprising a plurality of light-emitting members disposed on said circuit board and electrically connected to circuitry in said circuit board.

* * * * *